US006973910B2

(12) United States Patent
Ohtani

(10) Patent No.: US 6,973,910 B2
(45) Date of Patent: Dec. 13, 2005

(54) FUEL INJECTION CONTROL APPARATUS AND FUEL INJECTION CONTROL METHOD FOR INTERNAL COMBUSTION ENGINE

(75) Inventor: Motoki Ohtani, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 18 days.

(21) Appl. No.: 10/981,506

(22) Filed: Nov. 5, 2004

(65) Prior Publication Data

US 2005/0098154 A1 May 12, 2005

(51) Int. Cl.[7] ..... F02B 17/00
(52) U.S. Cl. ..... 123/295; 123/299
(58) Field of Search ..... 123/295, 299, 123/300, 435

(56) References Cited

U.S. PATENT DOCUMENTS

| | | | | |
|---|---|---|---|---|
| 6,561,157 | B2 * | 5/2003 | zur Loye et al. | 123/295 |
| 2001/0027769 | A1 * | 10/2001 | Mizuno et al. | 123/295 |
| 2001/0056322 | A1 * | 12/2001 | Yoshizawa et al. | 123/299 |

FOREIGN PATENT DOCUMENTS

| | | |
|---|---|---|
| JP | 10-061483 | 3/1998 |
| JP | 10-299563 | 11/1998 |
| JP | 2001-355488 | 12/2001 |
| JP | 2002/130007 | 5/2002 |

* cited by examiner

*Primary Examiner*—Erick Solis
(74) *Attorney, Agent, or Firm*—Kenyon & Kenyon

(57) ABSTRACT

An internal combustion engine includes an in-cylinder injection valve and an intake port injection valve. The engine is operated in a combustion mode that is selected from at least stratified lean combustion and homogeneous combustion. An ECU selects the combustion mode according to the operational state of the engine, and controls the fuel injection valves in a fuel injection mode that corresponds to the selected combustion mode. When a misfire is detected while the engine is operated in the stratified lean combustion or the homogeneous combustion, the ECU switches the fuel injection mode such that the ratio of the amount of fuel injected from the intake port injection valve to the entire amount of fuel supplied into the cylinder is increased. As a result, misfires are suppressed while preventing the fuel economy from deteriorating.

20 Claims, 2 Drawing Sheets

FUEL INJECTION CONTROL APPARATUS AND FUEL INJECTION CONTROL METHOD FOR INTERNAL COMBUSTION ENGINE

BACKGROUND OF THE INVENTION

The present invention relates to an apparatus and a method for controlling fuel injection in an internal combustion engine that includes a first fuel injection valve for injecting fuel into a cylinder and a second fuel injection valve for injecting fuel into an intake passage.

Conventionally, in an internal combustion engine having an in-cylinder injection valve for injecting fuel into a cylinder, "compression stroke injection" is performed to inject fuel into a combustion chamber during the compression stroke of a piston, so that stratified lean combustion, in which the air-fuel ratio is leaner than the stoichiometric air-fuel ratio, is performed. In the stratified lean combustion, a combustible air-fuel mixture having the stoichiometric or richer air-fuel ratio is generated only in the vicinity of the ignition plug. Thus, even if the overall air-fuel ratio in the combustion chamber is lean, the combustion is stabilized. As a result, the fuel economy is significantly improved.

However, if, for example, the fuel injection amount falls below a requested fuel injection amount due to deposits collected on the nozzle of the injection valve, the air-fuel ratio of the air-fuel mixture in the vicinity of the ignition plug will be leaner than the stoichiometric air-fuel ratio, which can cause a misfire to occur. Such a misfire is likely to occur in an operational range of the engine in which the requested fuel injection amount is small, for example, when the engine is idling.

Japanese Laid-Open Patent Publication No. 2002-130007 proposes that stratified stoichiometric combustion be performed as a measure against misfires during the stratified lean combustion. In the stratified stoichiometric combustion, fuel is injected both during the intake stroke and the compression stroke so that the air-fuel ratio in the entire combustion chamber becomes the stoichiometric air-fuel ratio, thereby generating an air-fuel mixture of which the air-fuel ratio is richer than the stoichiometric air-fuel ratio in the vicinity of the ignition plug. As a result, misfires due to a lean air-fuel ratio are prevented.

Incidentally, in an internal combustion engine having an in-cylinder injection valve, a misfire can occur even during homogeneous stoichiometric combustion in which fuel is injected during the intake stroke. This is because when fuel is injected during the intake stroke, the injected fuel is not sufficiently diffused throughout the entire combustion chamber by the time of ignition. As a result, due to an inhomogeneous air-fuel mixture, the air-fuel ratio in the vicinity of the ignition plug is lean, which may cause a misfire to occur.

In this manner, as a measure against misfires caused by a lean air-fuel ratio in the homogeneous combustion, it is effective to perform the above described stratified stoichiometric combustion for richening the air-fuel ratio in the vicinity of the ignition plug.

As a measure against misfires due to a lean air-fuel ratio, increasing the fuel injection amount for richening the air-fuel ratio in the vicinity of the ignition plug is effective. However, performing the stratified stoichiometric combustion, in which the fuel injection amount is greater than that in the stratified lean combustion, lowers the fuel economy.

In the stratified stoichiometric combustion, an air-fuel mixture of which the air-fuel ratio is richer than the stoichiometric air-fuel ratio, is generated in the vicinity of the ignition plug as described above, so that the air-fuel ratio in the entire combustion chamber becomes the stoichiometric air-fuel ratio. Therefore, some of the fuel injected into the combustion chamber can be discharged without being combusted.

SUMMARY OF THE INVENTION

Accordingly, it is an objective of the present invention to provide a fuel injection control apparatus and a fuel injection control method that readily prevents misfires while preventing the fuel economy from being lowered in an internal combustion engine that includes a fuel injection valve for injecting fuel into the cylinder in addition to a fuel injection valve for injecting fuel into the intake passage.

To achieve the foregoing and other objectives and in accordance with the purpose of the present invention, a fuel injection control apparatus for an internal combustion engine is provided. The engine has a first fuel injection valve for injecting fuel into a cylinder of the engine, and a second fuel injection valve for injecting fuel into an intake passage connected to the cylinder. The engine is operated in a combustion mode that is selected from at least stratified lean combustion and homogeneous combustion. The apparatus includes control means, misfire detecting means, and switching means. The control means selects the combustion mode according to the operational state of the engine and controls the fuel injection valves in a fuel injection mode that corresponds to the selected combustion mode. When the stratified lean combustion is selected, the control means causes the first fuel injection valve to inject fuel during the compression stroke of the engine. When the homogeneous combustion is selected, the control means causes the first fuel injection valve to inject fuel during the intake stroke of the engine. The misfire detecting means detects a misfire in the cylinder. When a misfire is detected by the misfire detecting means while the engine is operated in the stratified lean combustion or the homogeneous combustion, the switching means switches the fuel injection mode such that the ratio of the amount of fuel injected from the second fuel injection valve to the entire amount of fuel supplied into the cylinder is increased.

The present invention also provides an internal combustion engine that is operated in a combustion mode that is selected from at least stratified lean combustion and homogeneous combustion. The engine includes a cylinder, an intake passage connected to the cylinder, a first fuel injection valve for injecting fuel into the cylinder, a second fuel injection valve for injecting fuel into the intake passage, a controller, and a misfire detecting device. The controller selects the combustion mode according to operational state of the engine and controls the fuel injection valves in a fuel injection mode that corresponds to the selected combustion mode. When the stratified lean combustion is selected, the controller causes the first fuel injection valve to inject fuel during the compression stroke of the engine. When the homogeneous combustion is selected, the controller causes the first fuel injection valve to inject fuel during the intake stroke of the engine. The misfire detecting device detects a misfire in the cylinder. When a misfire is detected by the misfire detecting device while the engine is operated in the stratified lean combustion or the homogeneous combustion, the controller switches the fuel injection mode such that the ratio of the amount of fuel injected from the second fuel injection valve to the entire amount of fuel supplied into the cylinder is increased.

The present invention further provides a fuel injection control method for an internal combustion engine. The engine has a first fuel injection valve for injecting fuel into a cylinder of the engine, and a second fuel injection valve for injecting fuel into an intake passage connected to the cylinder. The engine is operated in a combustion mode that is selected from at least stratified lean combustion and homogeneous combustion. The method includes: selecting the combustion mode according to the operational state of the engine; controlling the fuel injection valves in a fuel injection mode that corresponds to the selected combustion mode, wherein, when the stratified lean combustion is selected, the first fuel injection valve injects fuel during the compression stroke of the engine, and wherein, when the homogeneous combustion is selected, the first fuel injection valve injects fuel during the intake stroke of the engine; monitoring for a misfire in the cylinder; and switching, when a misfire is detected while the engine is operating in the stratified lean combustion or the homogeneous combustion, the fuel injection mode such that the ratio of the amount of fuel injected from the second fuel injection valve to the entire amount of fuel supplied into the cylinder is increased.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of the present invention will now be described with reference to FIGS. 1 to 3.

Figure 1:
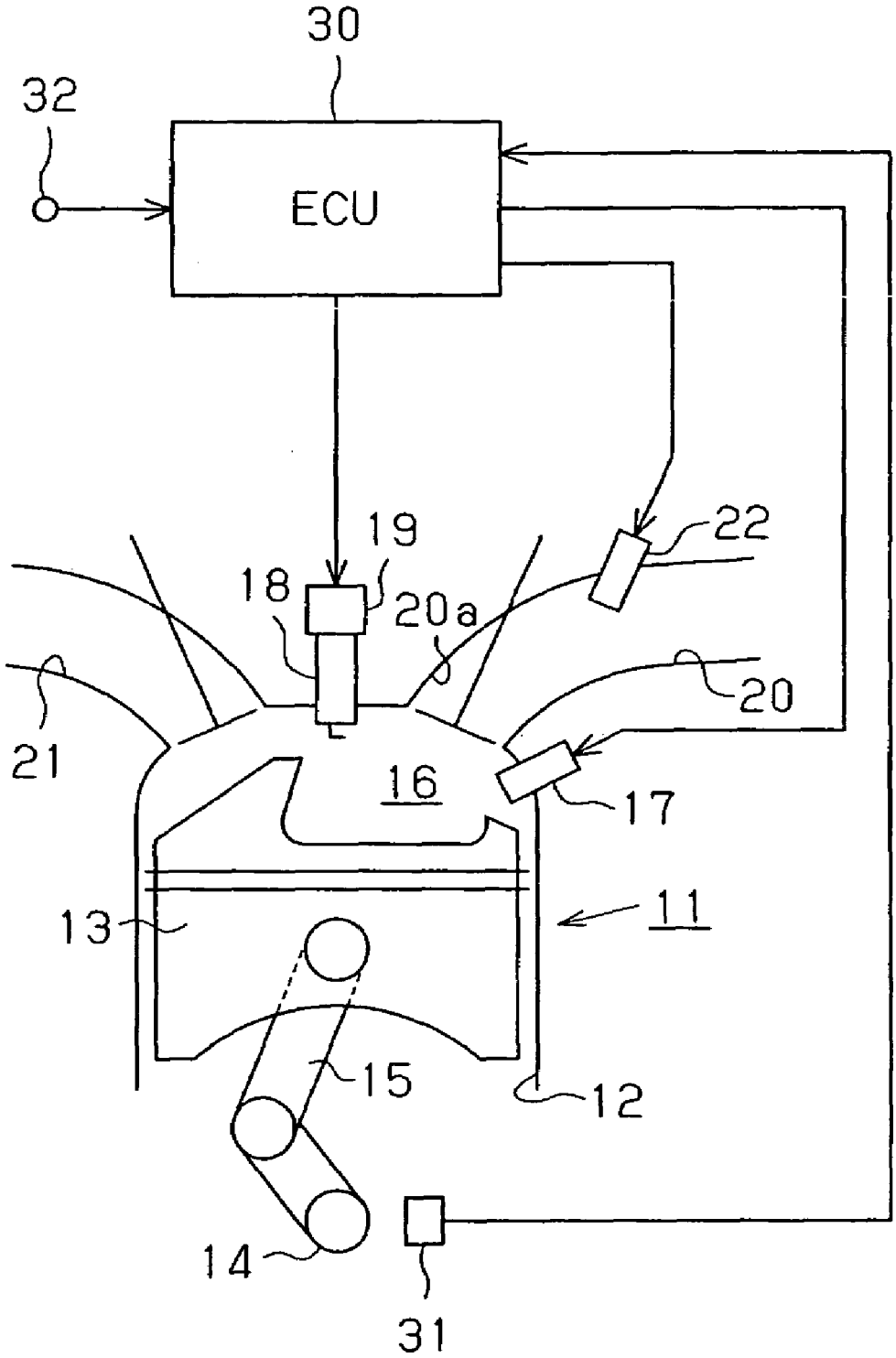
FIG. 1 is a block diagram illustrating a fuel injection control apparatus for an internal combustion engine according to one embodiment of the present invention.

As shown in FIG. 1, a fuel injection control apparatus according to this embodiment is applied to a four-cycle cylinder injection internal combustion engine 11. The engine 11 includes a piston 13 accommodated in a cylinder 12. The piston 13 is connected via a connecting rod 15 to a crankshaft 14, which is the output shaft for the engine 11. The connecting rod 15 converts reciprocation of the piston 13 into rotation of the crankshaft 14.

A combustion chamber 16 is defined in the cylinder 12 above the piston 13. The engine 11 includes an in-cylinder injection valve 17, which functions as a first fuel injection valve for directly injecting fuel into the combustion chamber 16. The in-cylinder injection valve 17 receives highly pressurized fuel through a fuel supply mechanism (not shown). The pressure of the supplied fuel is adjusted to a predetermined value. When the in-cylinder injection valve 17 is actuated to open, fuel is injected into the combustion chamber 16.

The engine 11 includes an ignition plug 18 that ignites the air-fuel mixture generated in the combustion chamber 16. The timing for igniting the air-fuel mixture by the ignition plug 18 is adjusted by an igniter 19 provided above the ignition plug 18. The upper end face of the piston 13 is shaped to be suitable for generation of stratified air-fuel mixture with fuel injected by the in-cylinder injection valve 17, and permitting the air-fuel mixture to reach the vicinity of the ignition plug 18 at the ignition timing.

The combustion chamber 16 is connected to an intake passage 20 and an exhaust passage 21. The joint between the combustion chamber 16 and the intake passage 20 forms an intake port 20*a*. An intake port injection valve 22, which functions as a second fuel injection valve, is provided to be exposed to the intake passage 20. The intake port injection valve 22 injects fuel toward the intake port 20*a*. The intake port injection valve 22 receives highly pressurized fuel through the fuel supply mechanism (not shown). The pressure of the supplied fuel is adjusted to a predetermined value. When the intake port injection valve 22 is actuated to open, fuel is injected toward the intake port 20*a*. The second fuel injection valve is not limited to the intake port injection valve 22 provided in the vicinity of the intake port 20*a*, but may be provided in a surge tank in the intake passage 20.

The apparatus includes an electronic control unit (ECU) 30 that controls the ignition plug 18 and the igniter 19, and various sensors used in control executed by the ECU 30. The ECU 30 is constructed with a microcomputer as the dominant constituent, and includes a central processing unit (CPU), read only memory (ROM), and random access memory (RAM). In this embodiment, as sensors for detecting the operational state of the engine 11, a rotational speed sensor 31 and a pedal sensor 32 are provided. The rotational speed sensor 31 detects the number of revolutions of the crankshaft 14 per unit time, or the engine speed, and the pedal sensor 32 detects the depression amount of an acceleration pedal (not shown). The rotational speed sensor 31 also functions as a sensor that detects misfire of the engine 11. Detection signals of these sensors 31, 32 are sent to the ECU 30.

Based on detection signals from the rotational speed sensor 31 and the pedal sensor 32, the ECU 30 detects the engine operational state and determines the combustion mode from stratified lean combustion, stratified stoichiometric combustion, and homogeneous stoichiometric combustion according to the detected engine operational state. The ECU 30 then sets the fuel injection timing and the fuel injection amount according to the determined combustion mode. In accordance with the set fuel injection timing and fuel injection amount, the ECU 30 causes at least one of the in-cylinder injection valve 17 and the intake port injection valve 22 to inject fuel. The fuel injection amount is determined based on the fuel injection pressure and the fuel injection duration.

In this embodiment, the ECU 30 and the rotational speed sensor 31 form misfire detecting means. That is, based on a detection signal from the rotational speed sensor 31, the ECU 30 detects that a misfire has occurred in the engine 11. Specifically, the ECU 30 detects the occurrence of a misfire in the engine 11 based on fluctuation of the engine rotational speed. A misfire is caused when in the combustion chamber 16, the air-fuel ratio of the air-fuel mixture in the vicinity of the ignition plug 18 is leaner than the stoichiometric air-fuel ratio.

When detecting a misfire, the ECU 30 switches the combustion mode that has been determined according to the engine operational state to a combustion mode that allows the air-fuel ratio of the air-fuel mixture in the vicinity of the ignition plug 18 to approach the stoichiometric air-fuel ratio. In other words, when detecting a misfire, the ECU 30 assigns a higher priority to performance of a combustion mode that suppresses misfires than to performance of a combustion mode that corresponds to the engine operational state.

Next, the relationship of each combustion mode with the misfire prevention capacity and the fuel economy will be described with reference to FIG. 2. FIG. 2 shows the relationship of each of the stratified lean combustion, the homogeneous stoichiometric combustion, and the stratified stoichiometric combustion, which are performed by injecting fuel from the in-cylinder injection valve 17, and the homogeneous stoichiometric combustion, which is performed by injecting fuel from the intake port injection valve 22, with the misfire prevention capacity and the fuel economy.

The stratified lean combustion is a combustion mode in which fuel is combusted while the air-fuel ratio is super lean in the entire combustion chamber 16. To perform the stratified lean combustion, the ECU 30 causes the in-cylinder injection valve 17 to inject fuel during the compression stroke of the piston 13.

The homogeneous stoichiometric combustion is a combustion mode in which fuel is combusted while the air-fuel ratio is the stoichiometric air-fuel ratio in the entire combustion chamber 16. When performing the homogeneous stoichiometric combustion with fuel injection from the in-cylinder injection valve 17, the ECU 30 causes the in-cylinder injection valve 17 to inject fuel during the intake stroke of the piston 13. On the other hand, when performing the homogeneous stoichiometric combustion with fuel injection from the intake port injection valve 22, the ECU 30 adjusts the fuel injection timing from the intake port injection valve 22 such that air-fuel mixture that stays in the intake port 20*a* is drawn into the combustion chamber 16 during the intake stroke of the piston 13.

The stratified stoichiometric combustion is a combustion mode in which fuel is combusted while the air-fuel ratio in the entire combustion chamber 16 is the stoichiometric air-fuel ratio. To perform the stratified stoichiometric combustion, the ECU 30 causes the in-cylinder injection valve 17 to inject fuel during the compression stroke of the piston 13.

Figure 2:
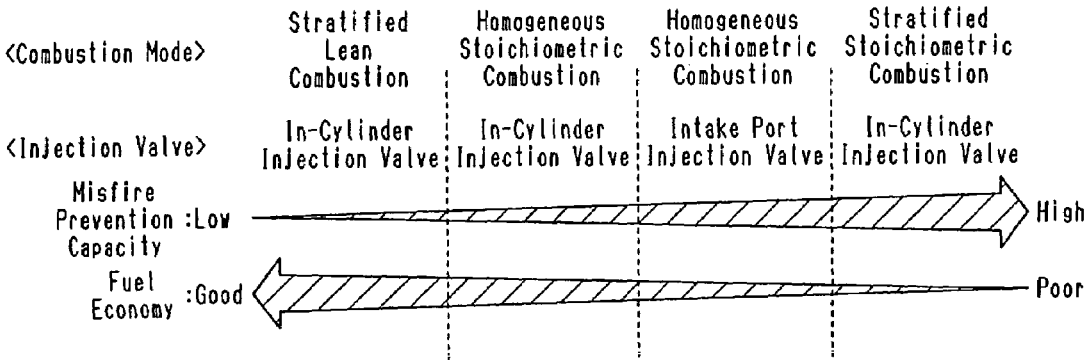
FIG. 2 is a diagram showing the relationship of the combustion mode with the misfire prevention capacity and the fuel economy.

As shown in FIG. 2, the fuel economy is optimized by making the air-fuel ratio in the entire combustion chamber 16 lean in the stratified lean combustion. However, since the air-fuel ratio in the vicinity of the ignition plug 18 is lean, a misfire is likely to occur. Therefore, the stratified lean combustion has the lowest capacity for misfire prevention.

In the homogeneous stoichiometric combustion by in-cylinder fuel injection, the air-fuel ratio in the entire combustion chamber 16 is adjusted to be the stoichiometric air-fuel ratio, while injecting fuel during the intake stroke to homogenize the air-fuel mixture. Therefore, the misfire prevention capacity of the homogeneous stoichiometric combustion by in-cylinder fuel injection is higher than that of the stratified lean combustion. However, the fuel economy of the homogeneous stoichiometric combustion by in-cylinder fuel injection is worse than that of the stratified lean combustion.

The misfire prevention capacity of the homogeneous stoichiometric combustion by intake port fuel injection is even higher than that of the homogeneous stoichiometric combustion by in-cylinder fuel injection. This is because, since the time from when fuel is injected into the combustion chamber 16 to when the mixture is ignited is extremely short, the injected fuel is not sufficiently diffused and the mixture is inhomogeneous. In other words, in the intake port fuel injection, the air-fuel mixture is sufficiently homogenized since the time from when the fuel is injected into the combustion chamber 16 to when the mixture is ignited is relatively long. However, the fuel economy of the homogeneous stoichiometric combustion by intake port fuel injection is worse than that of the homogeneous stoichiometric combustion by in-cylinder fuel injection.

In the stratified stoichiometric combustion, the air-fuel mixture is stratified by injecting fuel during the compression stroke while adjusting the air-fuel ratio in the entire combustion chamber 16 to be the stoichiometric air-fuel ratio. Thus, the air-fuel ratio in the vicinity of the ignition plug 18 is richened. Therefore, the stratified stoichiometric combustion has the highest capacity for misfire prevention. However, the air-fuel ratio in the vicinity of the ignition plug 18 can be overly richened. In such a case, some of the fuel injected into the combustion chamber 16 can be discharged without being combusted. Therefore, the stratified stoichiometric combustion has the lowest fuel economy.

In this manner, the misfire prevention capacity and the fuel economy conflict with each other. Performing the stratified stoichiometric combustion, which has the highest misfire prevention capacity, at the occurrence of a misfire degrades the fuel economy.

Hence, in this embodiment, taking the relationship between the misfire prevention capacity and the fuel economy into consideration, the fuel injection mode is switched such that the deterioration of the fuel economy is minimized, and the occurrence of misfires is reliably suppressed. Specifically, when a misfire occurs during the stratified lean combustion by in-cylinder fuel injection or the homogeneous stoichiometric combustion by in-cylinder fuel injection, the ECU 30 switches the fuel injection mode to perform the homogeneous stoichiometric combustion by intake port fuel injection.

Figure 3:
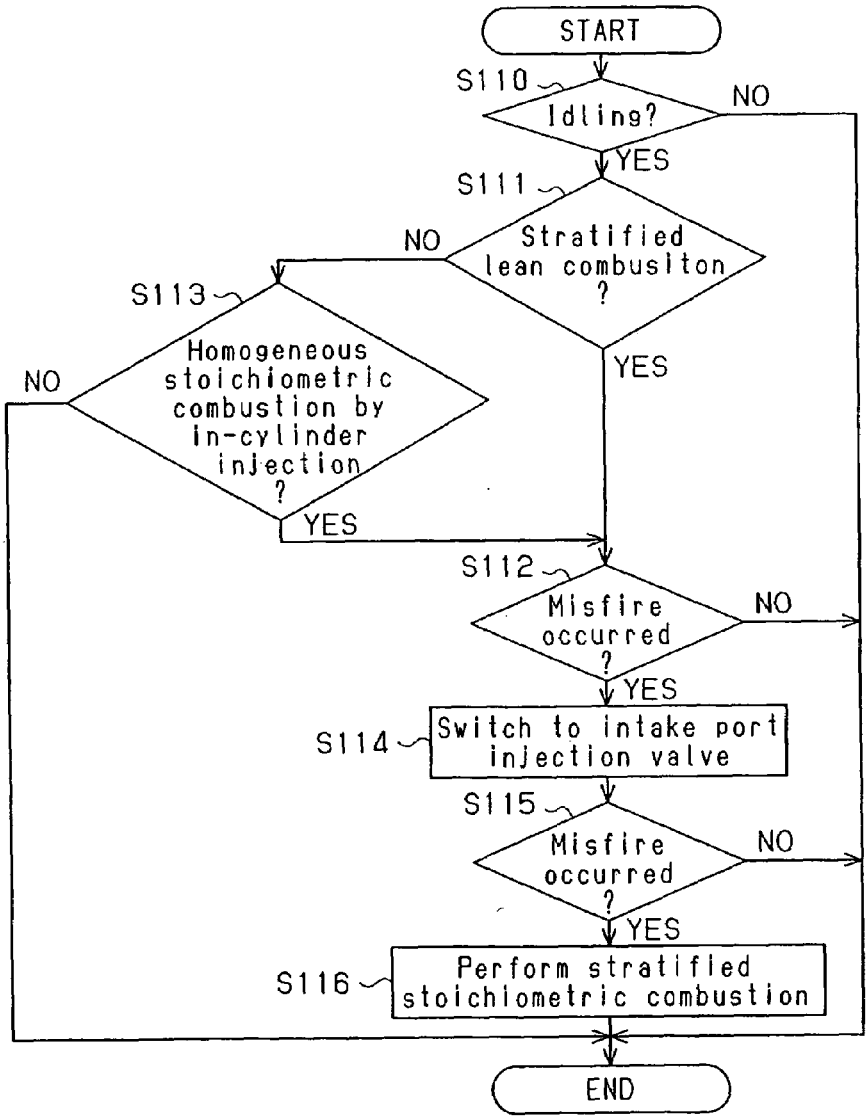
FIG. 3 is a flowchart showing a procedure for controlling fuel injection.

FIG. 3 is a flowchart showing a procedure of fuel injection control according to this embodiment. The control routine shown in FIG. 3 is executed by the ECU 30, which functions as switching means that switches the fuel injection mode according to a program stored in the ROM of the ECU 30.

When entering the routine, the ECU 30 at step S110 determines whether the engine 11 is idling. When determining that the engine is idling, the ECU 30 proceeds to step S111 and determines whether the stratified lean combustion by in-cylinder fuel injection is being executed. When determining that the stratified lean combustion is being executed, the ECU 30 proceeds to step S112.

On the other hand, when determining that the stratified lean combustion is not being executed at step S111, the ECU 30 proceeds to step S113 and determines whether the homogeneous stoichiometric combustion by in-cylinder fuel injection is being executed. When determining that the homogeneous stoichiometric combustion by in-cylinder fuel injection is being executed, the ECU 30 proceeds to step S112.

At step S112, the ECU 30 determines whether a misfire has occurred based on a detection signal from the rotational speed sensor 31. When determining that a misfire has occurred, the ECU proceeds to step S114. At step S114, the ECU 30 switches the fuel injection valve to inject fuel from the in-cylinder injection valve 17 to the intake port injection valve 22, thereby performing the homogeneous stoichiometric combustion by intake port fuel injection. Specifically, the ECU 30 stops fuel injection from the in-cylinder injection valve 17, and starts fuel injection only from the intake port injection valve 22, thereby performing the homogeneous stoichiometric combustion by intake port fuel injection. As a result, compared to the stratified lean combustion and the homogeneous stoichiometric combustion by in-cylinder fuel injection, the air-fuel ratio in the vicinity of the ignition plug 18 is closer to the stoichiometric air-fuel ratio, which reduces the possibility of misfires.

However, even during the homogeneous stoichiometric combustion by intake port fuel injection, there is still a possibility of the occurrence of misfires. For example, when the stratified lean combustion by in-cylinder fuel injection is switched to the homogeneous stoichiometric combustion by intake port fuel injection, the air-fuel ratio temporarily becomes lean. This can cause a misfire.

Hence, at step S115, the ECU 30 determines whether a misfire has occurred during the homogeneous stoichiometric combustion by intake port injection based on a detection signal from the rotational speed sensor 31. When determining that a misfire has occurred, the ECU proceeds to step S116. At step S116, the ECU 30 switches the fuel injection valve to inject fuel from the intake port injection valve 22 to the in-cylinder injection valve 17, thereby performing the stratified stoichiometric combustion by in-cylinder fuel injection. As a result, misfires are reliably prevented.

This embodiment provides the following advantages.

(1) When a misfire occurs during the stratified lean combustion by in-cylinder fuel injection or the homogeneous stoichiometric combustion by in-cylinder fuel injection, the ratio of the fuel injection amount from the intake port injection valve 22 to the entire fuel injection amount is increased. Specifically, when a misfire occurs during the stratified lean combustion by in-cylinder fuel injection or the homogeneous stoichiometric combustion by in-cylinder fuel injection, fuel injection by the in-cylinder injection valve 17 is stopped and fuel is injected only from the intake port injection valve 22, so that the homogeneous stoichiometric combustion by intake port fuel injection is performed. As a measure against misfires, the stratified stoichiometric combustion is most effective. However, the stratified stoichiometric combustion significantly degrades the fuel economy. In contrast to this, the homogeneous stoichiometric combustion by intake port fuel injection comparatively suppresses decrease in the fuel economy. Therefore, by switching the fuel injection mode such that the homogeneous stoichiometric combustion by intake port fuel injection is performed, the fuel economy is prevented from deteriorating, and misfires are prevented from occurring.

(2) In the illustrated embodiment, if a misfire occurs when the stratified lean combustion or the homogeneous stoichiometric combustion by in-cylinder fuel injection is being executed while the engine is idling, the fuel injection mode is switched such that the homogeneous stoichiometric combustion by intake port fuel injection is performed. A misfire is most likely to occur in an operational state in which the fuel injection amount is small, particularly when the engine is idling. According to the illustrated embodiment, a favorable measure against misfires is taken while taking the relationship between the misfire prevention capacity and the fuel economy into consideration when the engine 11 is idling.

(3) When a misfire occurs even if the homogeneous stoichiometric combustion by intake port fuel injection is started, the stratified stoichiometric combustion, which has the highest misfire prevention capacity, is performed. Thus, misfires are reliably prevented.

The above illustrated embodiment may be modified as follows.

Switching of the combustion mode when a misfire is detected may be changed as illustrated below.

(A1) When a misfire occurs during the stratified lean combustion by in-cylinder fuel injection or the homogeneous stoichiometric combustion by in-cylinder fuel injection (when the outcome of step S112 of FIG. 3 is YES), the homogeneous stoichiometric combustion may be performed by fuel injection from both of the in-cylinder injection valve 17 and the intake port injection valve 22. In this case, fuel injection from the intake port injection valve 22 is started, and until the misfire is suppressed the ratio of the fuel injection amount from the injection valve 22 is increased, and the ratio of the fuel injection amount from the in-cylinder injection valve 17 is decreased. Such switching of the fuel injection modes reliably suppresses misfires while preventing the fuel economy from deteriorating.

(A2) When a misfire is determined to have occurred during the homogeneous stoichiometric combustion by intake port fuel injection (when the outcome of step S115 of FIG. 3 is YES), the stratified stoichiometric combustion may be performed by fuel injection from the in-cylinder injection valve 17 during the compression stroke and fuel injection from the intake port injection valve 22. The stratified stoichiometric combustion in which fuel is injected from both of the injection valves 17, 22 reliably prevents misfires.

(A3) When a misfire is determined to have occurred during the homogeneous stoichiometric combustion by intake is YES), the stratified stoichiometric combustion may be performed by fuel injection from the in-cylinder injection valve 17 during the compression stroke and the intake stroke. Performing the stratified stoichiometric combustion in such a manner also reliably prevents misfires.

In the illustrated embodiment, if a misfire occurs when the in-cylinder injection valve 17 is injecting fuel, that is, if a misfire occurs during the stratified lean combustion or the homogeneous stoichiometric combustion by in-cylinder fuel injection, the fuel injection mode is switched such that the ratio of the fuel injection amount from the intake port injection valve 22 to the entire fuel injection amount is increased. However, the fuel injection mode may be switched in the same manner if a misfire occurs while fuel is injected both from the in-cylinder injection valve 17 and the intake port injection valve 22. In this case, the fuel injection mode is switched such that the ratio of the fuel injection amount from the intake port injection valve 22 to the entire fuel injection amount is increased while injecting fuel from both of the injection valves 17, 22.

Further, during a combustion mode other than the stratified lean combustion and the homogeneous stoichiometric combustion by in-cylinder fuel injection, if a misfire occurs due to a small amount of fuel injection, the fuel injection mode may be switched such that the ratio of the fuel injection amount from the intake port injection valve 22 to the entire fuel injection amount is increased, thereby taking a measure against misfires.

The combustion mode may be switched in a state other than the state where the stratified lean combustion or the homogeneous stoichiometric combustion by in-cylinder fuel injection is being performed while the engine is idling. For example, even in a state where the engine is operating with a low load, if a misfire occurs due to a small amount of fuel injection, the fuel injection mode may be switched such that the ratio of the fuel injection amount from the intake port injection valve 22 to the entire fuel injection amount is increased, thereby taking a measure against misfires.

In the illustrated embodiment, the fuel injection mode is switched such that the ratio of the fuel injection amount from the intake port injection valve 22 to the entire fuel injection amount is increased based on the occurrence of misfires. In this case, the increased ratio of the fuel injection amount may be changed as necessary according to the frequency of misfires.

In the illustrated embodiment, the stratified stoichiometric combustion is performed when a misfire is detected after the combustion is switched to the homogeneous stoichiometric combustion by intake port fuel injection. However, instead of the stratified stoichiometric combustion, the ratio of the fuel injection amount from the intake port injection valve 22 to the entire fuel injection fuel amount may be further increased.

In this embodiment, the rotational speed sensor 31 and the ECU 30 form misfire detecting means. However, for example, a combustion pressure sensor for detecting the combustion pressure in the combustion chamber 16 and the ECU 30 may form misfire detecting means, so that the ECU 30 detects a misfire based on a detection signal from the combustion pressure sensor. The configuration with such a combustion pressure sensor improves the detection accuracy of misfires.

In the illustrated embodiment, the ECU 30 detects a misfire of the engine 11 based on a detection signal from the rotational speed sensor 31, and switches the fuel injection mode based on the result of the misfire detection. However, in addition to a case where a misfire is detected in this manner, the ECU 30 may detect a state that causes misfires, for example, a combustion fluctuation, and switch the combustion mode based on the detection result.

The present examples and embodiments are to be considered as illustrative and not restrictive and the invention is not to be limited to the details given herein, but may be modified within the scope and equivalence of the appended claims.

What is claimed is:

1. A fuel injection control apparatus for an internal combustion engine, wherein the engine has a first fuel injection valve for injecting fuel into a cylinder of the engine, and a second fuel injection valve for injecting fuel into an intake passage connected to the cylinder, the engine is operated in a combustion mode that is selected from at least stratified lean combustion and homogeneous combustion, the apparatus comprising;

control means that selects the combustion mode according to the operational state of the engine and controls the fuel injection valves in a fuel injection mode that corresponds to the selected combustion mode, wherein, when the stratified lean combustion is selected, the control means causes the first fuel injection valve to inject fuel during the compression stroke of the engine, and wherein, when the homogeneous combustion is selected, the control means causes the first fuel injection valve to inject fuel during the intake stroke of the engine;

misfire detecting means for detecting a misfire in the cylinder; and switching means, wherein, when a misfire is detected by the misfire detecting means while the engine is operated in the stratified lean combustion or the homogeneous combustion, the switching means switches the fuel injection mode such that the ratio of the amount of fuel injected from the second fuel injection valve to the entire amount of fuel supplied into the cylinder is increased.

2. The apparatus according to claim 1, wherein, when a misfire is detected by the misfire detecting means, the switching means causes the first fuel injection valve to stop injecting fuel so that only the second fuel injection valve injects fuel.

3. The apparatus according to claim 1, wherein, when the stratified lean combustion or the homogeneous combustion is performed, the control means causes only the first fuel injection valve to inject fuel, and wherein, when a misfire is detected by the misfire detecting means, the switching means causes the first fuel injection valve to stop injecting fuel so that only the second fuel injection valve injects fuel, thereby operating the engine in homogenous stoichiometric combustion.

4. The apparatus according to claim 1, wherein, when a misfire is detected by the misfire detecting means, the switching means increases the ratio of the amount of fuel injected from the second fuel injection valve while causing both of the first and second fuel injection valves to inject fuel.

5. The apparatus according to claim 1, wherein, when the stratified lean combustion or the homogeneous combustion is performed, the control means causes only the first fuel injection valve to inject fuel, and wherein, when a misfire is detected by the misfire detecting means, the switching means causes both of the first and second fuel injection valves to inject fuel, thereby operating the engine in homogenous stoichiometric combustion.

6. The apparatus according to claim 4, wherein, from when a misfire is detected to when the misfire is suppressed, the switching means gradually increases the ratio of the amount of fuel injected from the second fuel injection valve.

7. The apparatus according to claim 1, wherein, in a case where the fuel injection mode is switched due to detection of a misfire and the misfire is still detected by the misfire detecting means after the switching of the fuel injection mode, the switching means causes the first fuel injection valve to inject fuel during the compression stroke of the engine, thereby operating the engine in stratified stoichiometric combustion.

8. The apparatus according to claim 1, wherein, in a case where the fuel injection mode is switched due to detection of a misfire and a misfire is still detected by the misfire detecting means after the switching of the fuel injection mode, the switching means causes the first fuel injection valve to inject fuel during the compression stroke of the engine and causes the second fuel injection valve to inject fuel, thereby operating the engine in stratified stoichiometric combustion.

9. The apparatus according to claim 1, wherein, in a case where the fuel injection mode is switched due to detection of a misfire and the misfire is still detected by the misfire detecting means after the switching of the fuel injection mode, the switching means causes the first fuel injection valve to inject fuel during the compression stroke and the intake stroke of the engine, thereby operating the engine in stratified stoichiometric combustion.

10. The apparatus according to claim 1, wherein, when the engine is idling, the switching means switches the fuel injection mode based on detection of misfire.

11. An internal combustion engine that is operated in a combustion mode that is selected from at least stratified lean combustion and homogeneous combustion, the engine comprising:

a cylinder;

an intake passage connected to the cylinder;

a first fuel injection valve for injecting fuel into the cylinder;

a second fuel injection valve for injecting fuel into the intake passage;

a controller that selects the combustion mode according to operational state of the engine and controls the fuel injection valves in a fuel injection mode that corresponds to the selected combustion mode, wherein, when the stratified lean combustion is selected, the controller causes the first fuel injection valve to inject fuel during the compression combustion is selected, the controller causes the first fuel injection valve to inject fuel during the intake stroke of the engine; and a misfire detecting device for detecting a misfire in the cylinder, wherein, when a misfire is detected by the misfire detecting device while the engine is operated in the stratified lean combustion or the homogeneous combustion, the controller switches the fuel injection mode such that the ratio of the amount of fuel injected from the second fuel injection valve to the entire amount of fuel supplied into the cylinder is increased.

12. The internal combustion engine according to claim 11, wherein, when a misfire is detected by the misfire detecting device, the controller causes the first fuel injection valve to stop injecting fuel so that only the second fuel injection valve injects fuel.

13. The internal combustion engine according to claim 11, wherein, when the stratified lean combustion or the homogeneous combustion is performed, the controller causes only the first fuel injection valve to inject fuel, and wherein, when a misfire is detected by the misfire detecting device, the controller causes the first fuel injection valve to stop injecting fuel so that only the second fuel injection valve injects fuel, thereby operating the engine in homogenous stoichiometric combustion.

14. The internal combustion engine according to claim 11, wherein, when a misfire is detected by the misfire detecting device, the controller increases the ratio of the amount of fuel injected from the second fuel injection valve while causing both of the first and second fuel injection valves to inject fuel.

15. The internal combustion engine according to claim 11, wherein, when the stratified lean combustion or the homogeneous combustion is performed, the controller causes only the first fuel injection valve to inject fuel, and wherein, when a misfire is detected by the misfire detecting device, the controller causes both of the first and second fuel injection valves to inject fuel, thereby operating the engine in homogenous stoichiometric combustion.

16. The internal combustion engine according to claim 14, wherein, from when a misfire is detected to when the misfire is suppressed, the controller gradually increases the ratio of the amount of fuel injected from the second fuel injection valve.

17. A fuel injection control method for an internal combustion engine, wherein the engine has a first fuel injection valve for injecting fuel into a cylinder of the engine, and a second fuel injection valve for injecting fuel into an intake passage connected to the cylinder, the engine is operated in a combustion mode that is selected from at least stratified lean combustion and homogeneous combustion, the method comprising:

selecting the combustion mode according to the operational state of the engine;

controlling the fuel injection valves in a fuel injection mode that corresponds to the selected combustion mode, wherein, when the stratified lean combustion is selected, the first fuel injection valve injects fuel during the compression stroke of the engine, and wherein, when the homogeneous combustion is selected, the first fuel injection valve injects fuel during the intake stroke of the engine;

monitoring for a misfire in the cylinder; and switching, when a misfire is detected while the engine is operating in the stratified lean combustion or the homogeneous combustion, the fuel injection mode such that the ratio of the amount of fuel injected from the second fuel injection valve to the entire amount of fuel supplied into the cylinder is increased.

18. The fuel injection control method according to claim 17, wherein, when a misfire is detected, the first fuel injection valve is caused to stop injecting fuel so that only the second fuel injection valve injects fuel.

19. The fuel injection control method according to claim 17, wherein said switching includes increasing the ratio of the amount of fuel injected from the second fuel injection valve while causing both of the first and second fuel injection valves to inject fuel.

20. The fuel injection control method according to claim 17, further comprising causing the first fuel injection valve to inject fuel during the compression stroke of the engine, thereby operating the engine in stratified stoichiometric combustion if a misfire is detected after said switching.

* * * * *

UNITED STATES PATENT AND TRADEMARK OFFICE

CERTIFICATE OF CORRECTION

PATENT NO. : 6,973,910 B2
APPLICATION NO. : 10/981506
DATED : December 13, 2005
INVENTOR(S) : Motoki Ohtani It is certified that error appears in the above-identified patent and that said Letters Patent is hereby corrected as shown below:

On the Title Page:

After " (65) Prior Publication Data
US 2005/0098154 A1 May 12, 2005"

Insert:

--(30) Foreign Application Priority Data

Nov. 11, 2003 (JP) .....P2003-381538 --

Signed and Sealed this

Twenty-second Day of August, 2006

JON W. DUDAS
*Director of the United States Patent and Trademark Office*